United States Patent [19]

Wong et al.

[11] 4,361,466

[45] Nov. 30, 1982

[54] AIR IMPINGEMENT WEB DRYING METHOD AND APPARATUS

[75] Inventors: George H. Wong, Roscoe, Ill.; Lamar Embry, Tacoma, Wash.; Donald A. Ely, Roscoe, Ill.; Peter F. Pantaleo; Ronald D. Cooke, both of Beloit, Wis.; James L. Chance, Rockton, Ill.; Edward D. Beachler, Beloit, Wis.

[73] Assignee: Beloit Corporation, Beloit, Wis.

[21] Appl. No.: 143,837

[22] Filed: Apr. 25, 1980

Related U.S. Application Data

[63] Continuation of Ser. No. 47,766, Jun. 12, 1979, abandoned, and a continuation of Ser. No. 846,177, Oct. 27, 1977, abandoned.

[51] Int. Cl.[3] ..... D21F 1/36; D21F 5/02; D21F 5/14

[52] U.S. Cl. ..... 162/207; 162/359; 162/374; 34/18; 34/23; 34/68; 34/117; 34/155

[58] Field of Search ..... 162/193, 206, 207, 255, 162/290, 350, 359, 364, 374, 360 R; 34/16, 18, 23, 68, 115, 116, 117, 155, 159, 161

[56] References Cited

U.S. PATENT DOCUMENTS

| | | | |
|---|---|---|---|
| 1,144,896 | 6/1915 | Fosbraey | 34/155 X |
| 1,463,923 | 8/1923 | Nelson | 34/155 |
| 2,300,982 | 11/1942 | Slagbloom | 34/155 |
| 2,857,822 | 10/1958 | Heys | 162/255 X |
| 3,029,871 | 4/1962 | Hornbostel | 162/350 |
| 3,125,424 | 3/1964 | Peck | 34/155 |
| 3,284,285 | 11/1966 | Holden | 162/207 X |
| 3,370,359 | 2/1968 | Beachler | 34/155 X |
| 3,438,854 | 4/1969 | Means | 162/374 |
| 3,874,997 | 4/1975 | Kankaanpää162 | 290/ |

FOREIGN PATENT DOCUMENTS

| | | |
|---|---|---|
| 890582 | 3/1962 | United Kingdom . |
| 1021683 | 3/1966 | United Kingdom . |
| 1191536 | 5/1970 | United Kingdom . |
| 1389992 | 4/1975 | United Kingdom . |

*Primary Examiner*—Richard V. Fisher

*Attorney, Agent, or Firm*—Hill, Van Santen, Steadman, Chiara & Simpson

[57] ABSTRACT

A method and mechanism for dewatering a web in a paper making machine having press means, a first thermal dryer section having a long continuous support looped belt carrying the web along a first drying run with rolls and suction zones beneath the web and a hot air generating means for directing a flow of air onto the web in the first thermal run with the web being received substantially 40% bone dry at the beginning of the first thermal run and being delivered substantially 50% bone dry at the end of the run onto a heated drum dryer section.

11 Claims, 7 Drawing Figures

Fig. 2
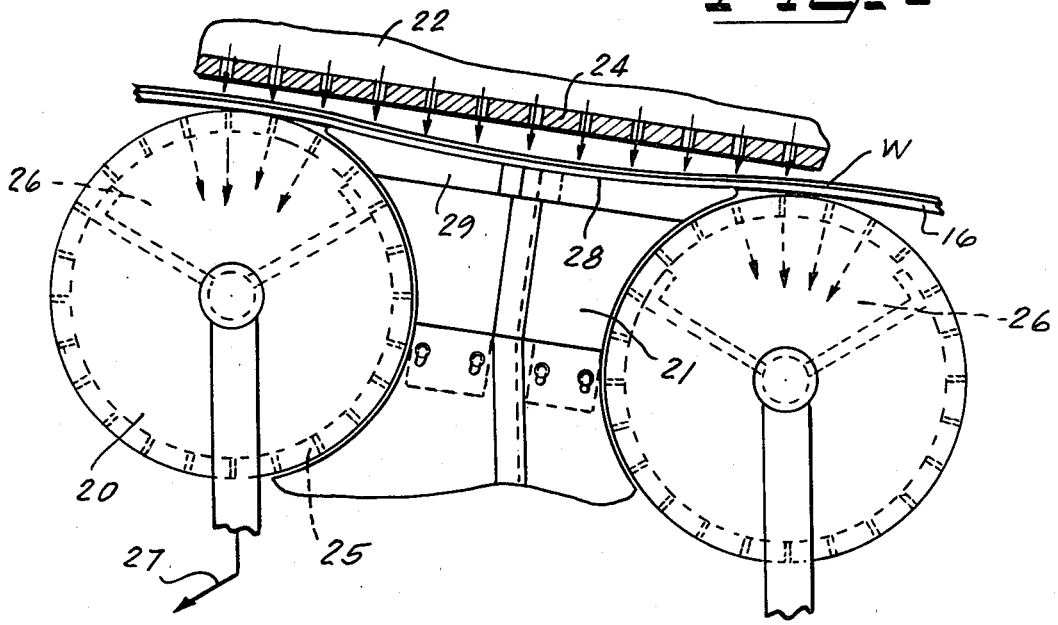
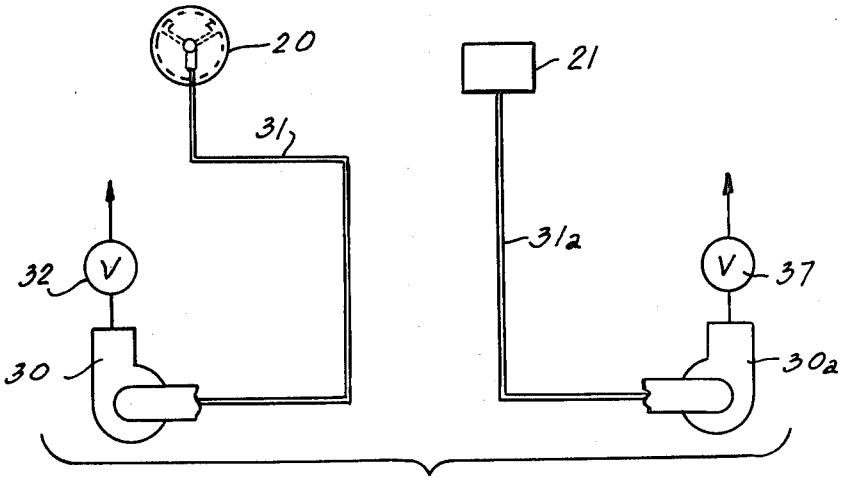
Fig. 3
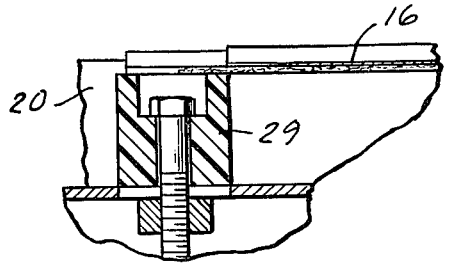
Fig. 4

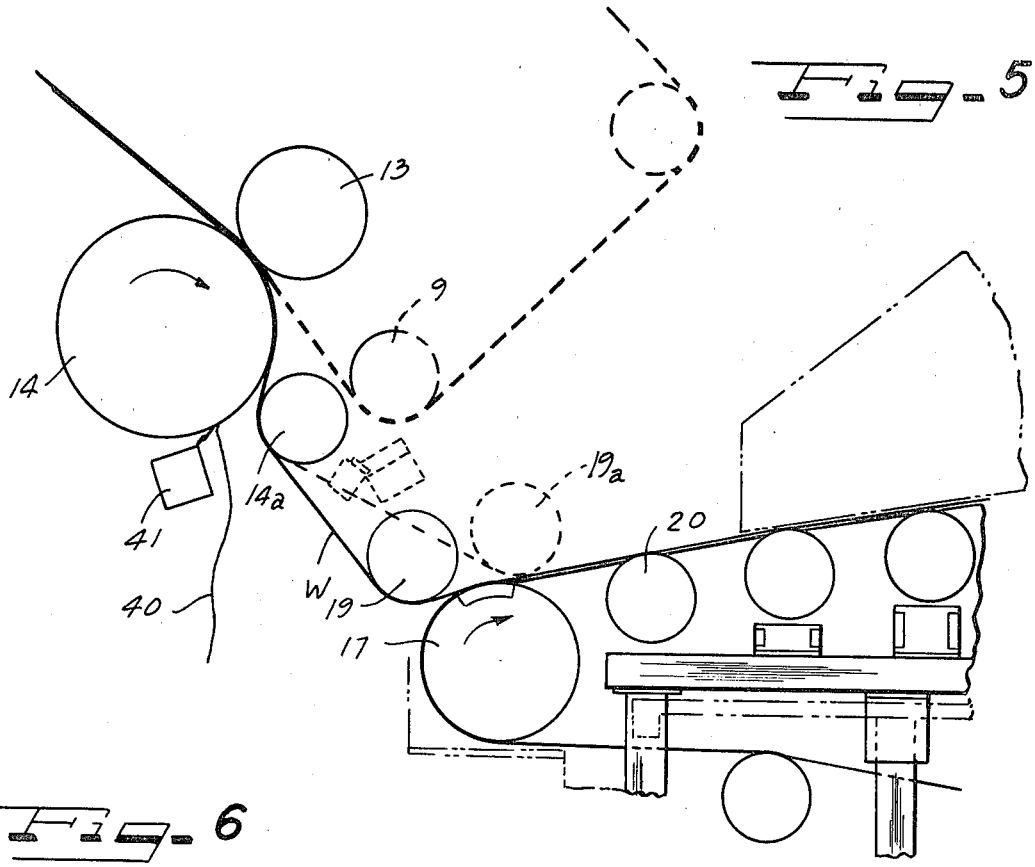
Fig. 5
Fig. 6
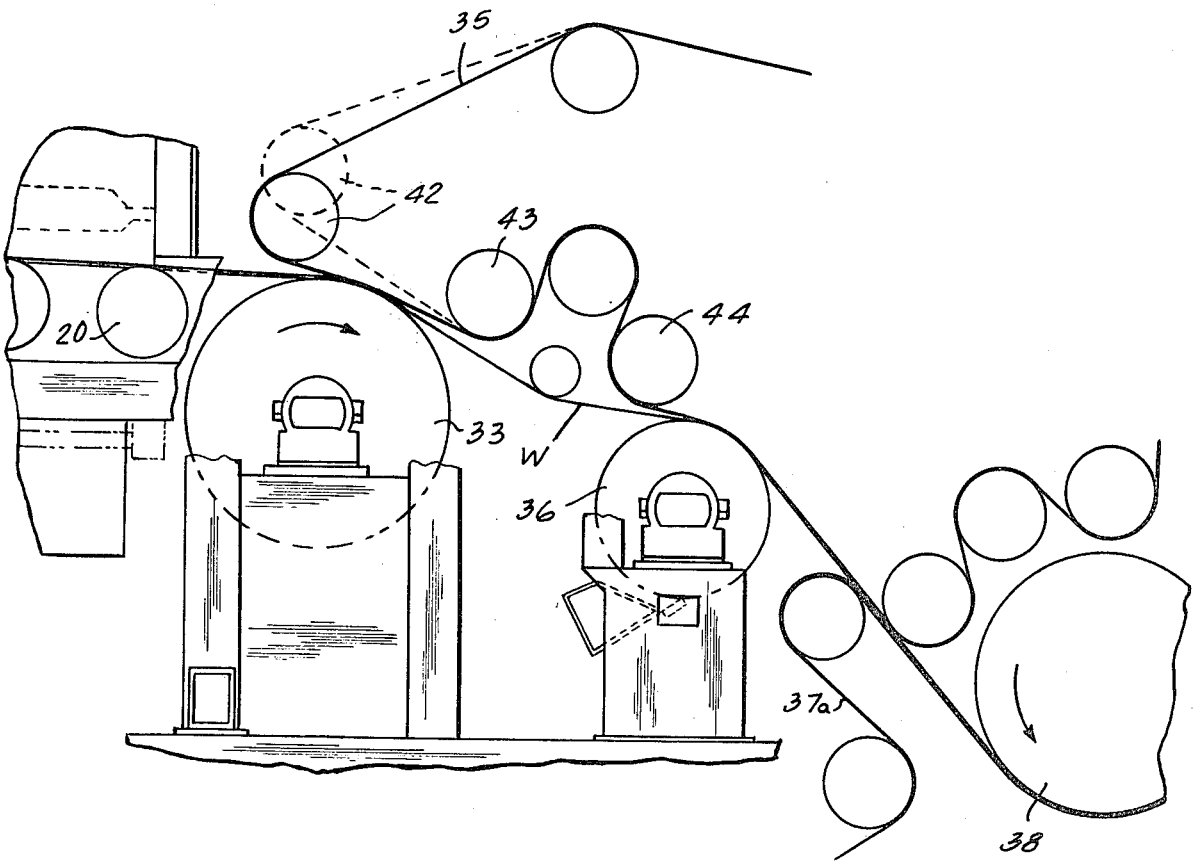

AIR IMPINGEMENT WEB DRYING METHOD AND APPARATUS

This is a continuation of application Ser. No. 846,176 filed Oct. 27, 1977 and Ser. No. 047,766, filed June 12, 1979, both now abandoned.

BACKGROUND OF THE INVENTION

The invention relates to improvements in paper making machines, and more particularly to improvements in dewatering a web by thermal means which permits the machine to be run at high speeds.

In the continual striving for increased speed of operation in paper making machines, speeds above 3000 feet per minute in existing machines have encountered difficulty in the occurrence of flutter and breaks in the dryer section. One of the reasons is that the web is insufficiently dried and does not have sufficient strength to carry across the open draws necessary in a standard dryer where the web is threaded in a serpentine path back and forth between dryer drums. It has been discovered that if the web is dried to on the order of 50% bone dry, it will have the strength and stability to withstand an open draw between the dryer rolls. It is impractical to attain this dryness in a press section.

It is accordingly an object of the present invention to provide a high speed paper making machine for the production of fibrous paper web, particularly such as newsprint, which can operate at high speeds on the order of above 3000 feet per minute without encountering breaks or other damage to the web at the beginning of the dryer section.

In accomplishing the foregoing objective in accordance with the principles of the present invention, the web is carried on a first dryer run between the press and standard dryer section being continuously supported so that no flutter or wrinkling can occur. During this first dryer run, the web is dried from about 40% bone dry as it is received from the press section and leaves this run on the order of about 50% bone dry at which time it will have strength and stability to withstand an open draw in passing through the regular dryer drum section. The long continuous support on the run is provided in the form of an endless belt. Difficulties have been encountered in such support in providing stability to the belt, accommodating evaporation of the moisture from the web on the belt, imparting thermal energy at a sufficient temperature to cause meaningful evaporation from the web during the time it is supported and providing engagement between the web and the belt without generating air pockets or floating of the web such as caused by inadvertently capturing air between the web and the belt at high operating speeds.

It is accordingly a further object of the present invention to provide a mechanism which drives the web between the press section and dryer drum section by providing a long continuous support for the web and providing for heated air impingement on the web during its term of long continuous support.

A further object of the invention is to provide a support means for the belt which provides a long continuous support for the web which is capable of stable operation for long periods of time which eliminates pockets of air beneath the web, permits imparting thermal energy to the web without damage to the belt and accommodates satisfactory high speed transfer to the belt from the press section and from the belt to the dryer drums at the end of the long continuous supported run.

The invention provides a continuous looped belt of porous material capable of withstanding the high temperatures of the heated air, either inherently or by being provided with a heat resistant coating on the upper surface and a roll with a suction gland on the lead end for transfer of the web onto the belt without inducing a cushion of air beneath the web, and a heated air generating means for directing a blanket of heated drying air continuously onto the upper surface of the web while it is carried on the belt support. The belt is supported over a long slightly arcuate path on successive porous rolls with suction boxes therebetween. These suction "boxes" might more appropriately be characterized as suction zones within a single suction box extending the length of the first dryer run under the support belt. The porous rolls themselves define the sides of these zones with the ends being constructed of sheet metal. There are no tops since the belt is supported between successive porous rolls over each zone. The rolls are perforate and have suction ventilating glands therein so that air is removed beneath the porous belt. Between the spaced parallel rolls are the suction zones with curved edge surfaces. At the end of the long continuous run is a roll within the belt, preferably an ordinary heated dryer drum roll, over which the belt and web pass immediately before the web is threaded onto a felt to pass through the dryer drum section.

Other objects, advantages and features as well as equivalent structures and methods which are intended to be covered herein, will become more apparent with the teaching of the principles of the invention in connection with the disclosure of the preferred embodiments in the specification, claims, and drawings, in which:

DRAWINGS

FIG. 2 is an enlarged detailed side elevational view, partially in section, of a portion of the first thermal drying run;

FIG. 3 is a fragmentary schematic view of a suction arrangement for the rolls and suction box;

FIG. 4 is a fragmentary detailed view of the suction box structure;

FIG. 5 is a fragmentary schematic side elevational view somewhat enlarged from FIG. 1 illustrating the entering end of the first dryer section;

FIG. 6 is a fragmentary diagrammatic side elevational view slightly enlarged from FIG. 1 showing the discharge end of the first dryer section.

DESCRIPTION

Figure 1:
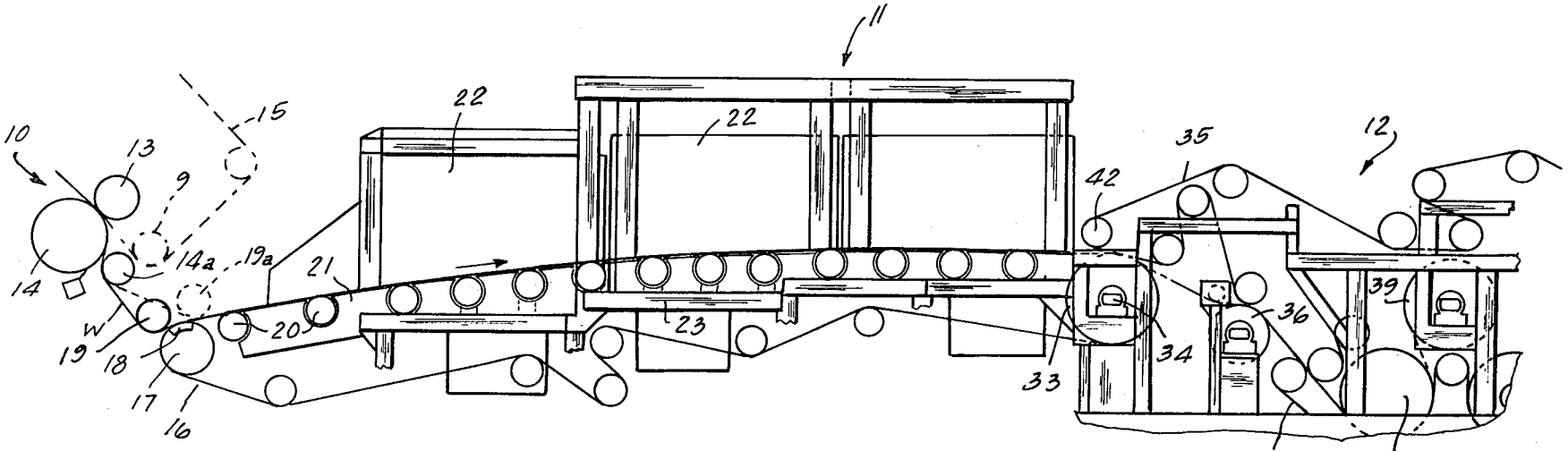
FIG. 1 is a side elevational view in somewhat schematic form of a dewatering section of a paper making machine constructed and operating in accordance with the principles of the present invention.

As illustrated in FIG. 1, a wet web W which has been formed in a forming section, is passed through a press section 10. Thereafter the web is thermally dried in a first drying run 11 while being continually supported to avoid fluttering and wrinkling. Following the run 11, the web is transferred to the second thermal run 12 which comprises standard dryer drums. In the first or intermediate run 11, the web enters from the press section at a dryness of about 40% bone dry, and in that condition does not have sufficient strength to stand the fluttering to which it will be subjected if it is passed directly to a dryer drum section. The web, therefore, receives full support in such a manner that air currents cannot cause flutter when it is dried to a bone dryness on the order of 50% at which time it has sufficient strength to be handled by a standard dryer section and can withstand the fluttering which occurs.

The web is illustrated leaving the press section, passing through a last press nip between press rolls 13 and 14 having a felt 15 passing through the nip. The felt passes upwardly over felt roll 9 for its return run. The web passes downwardly over a roll 14*a* and is laid onto a long continual support belt 16. The belt extends for a substantial run being supported in a slightly arcuate path as illustrated so that the belt can be tensioned and held without any up and down movement or flutter itself.

At the lead end of the long continuous support run of the belt 16 is a belt support roll 17 having a small suction gland 18 therein to firmly transfer the web onto the belt. The web passes over a roll 19 which is adjustable in position as shown by the dotted lines 19*a* so as to control the location where the web is laid onto the belt relative to the suction gland 18, for threading.

The web is carried on the upper surface of the belt, and the belt is formed of a porous material and has a surface extending across the full width of the web and providing full and complete support therefor. While on the belt, the web is subjected to a flow of drying air from above from a mechanism of the type known in the art as an air cap. Inasmuch as the web is supported only from below, the possibility of scuffing which could occur if the web is carried between two belts is avoided. The porous belt is preferably coated on its upper surface with a heat resistant material of a type which can withstand air drying temperatures up to 500° F., 245° C. The belt is preferably maintained at a tension to reduce the possibility of wrinkling or fluttering, and tensions up to 30 pli are preferred. These tensions are maintained by stretch rolls, not shown, within the looped belt. By training the belt over an arcuate surface, this tension is readily maintained in such a manner so that the web receives continual nonfluttering support. It will be noted that with the effect of training the belt over an arcuate path, that is, over an upwardly curved convex path, the web is maintained taut or under a slight tension as it is bowed upwardly on the belt to thereby help insure that no wrinkles or fluttering occur in the web.

Above the belt are arranged air caps 22. These are supplied with a flow of heated air to be able to deliver air of a temperature of a sufficient degree that can be withstood by the belt and temperatures of up to 500° F. have been utilized successfully, and it is believed under certain conditions that temperatures up to 900° F., 480° C. may be used.

The air caps are constructed as enclosures with perforate lower surfaces 24 as illustrated in FIG. 2. The air caps are arranged to extend the full width of the belt and web, and arrangements can be provided so that cooling air may be directed against the belt surface at the exposed edge of the belt not covered by the web to prevent its being damaged by being directly exposed to the heated air.

Support for the continuous belt is provided by a series of spaced horizontal support rolls 20. These rolls have a hollow construction as shown in FIG. 2 with a compartment 26 therein extending for the length of the roll, and the roll has a perforate outer shell surface. Suction is applied to the compartment 26 through a suction line 27 so that a continual slight vacuum will be applied to the lower surface of the belt preventing any build up of air therebeneath due to the induced flow of air with rotation of the rolls 20 or to the layer of air carried by the traveling belt.

Between each of the rolls is a suction box 21 with the first box meeting the oncoming web being tilted toward the oncoming direction of the belt. Inasmuch as the belt is under tension, it will tend to be stretched tangentially between its points of contact with the upper surface rolls but will depend slightly in a catenary curve. The top edges 28 of the sides of suction boxes 21 are curved to conform substantially to the curvature of the belt between the rolls. The end walls of the suction box are made of sheet metal, and at the upper edges 28 of the end walls are plastic shoes 29 for nonwearing engagement with the belt.

Suction is applied to the compartment 26 within the rolls and into the interior of the suction box 21 provided by separate suction pumps 30, 30*a*, FIG. 3, which connects through suitable lines 31, 31*a* to the rolls and suction boxes. Control of the applied suction is accomplished by a valving arrangement shown somewhat schematically at 32 and 37. The suction which is applied beneath the belt is relatively light and on the order of 1"–2" $H_2O$, although at threading a higher suction is applied. When threading a web through the machine, the web will have a leading tail which will be less width than the full width web and to insure retention of the tail and threading of the web, a higher suction on the order 4" $H_2O$ is applied. This is done by setting of the valves 32 and 37 to the higher suction during threading and then shifting to a position of the regular suction during normal operation. The web is dewatered and begins at 35% to 45% bone dry at the beginning of the run and is dried to 45% to 55% bone dry at the end of the run.

With this arrangement, two important objectives are provided in that the web is being dried from about 40% bone dry at the run beginning to about 50% bone dry at the end of the run while simultaneously being continually supported without any possibility of flutter or wrinkle. The other objective which is served is the support of the web on a belt with the spoiling of any induced air cushion which might tend to form between the web and supporting belt and between the belt and supporting rolls 20. This is achieved by the fact that there is no open draw which supports the objective of continuous support and avoids the inducement of air, and the spoiling of air layers is additionally achieved by the application of suction beneath the porous belt.

Preferably, the suction compartments 26 in rolls 20 are slightly tilted toward the oncoming felt so this additionally functions to spoil any wedge of induced air which tends to be carried between the felt and pass up to cushion the web on the belt.

The air caps have a perforated plate on the bottom, as shown at 24 in FIG. 2, and the holes in this plate are on the order of approximately $\frac{3}{8}$" in diameter. Air is blown through the distribution of holes onto the web at a velocity of about 24,000 feet per minute at the temperature of about 500° F. This temperature, of course, will be increased in accordance with the ability of the belt to withstand heat. At the downstream or terminal end of the first run where the web is supported on the belt, inside the belt is a heated roll 33 which provides additional drying heat, but primarily functions as a driving roll for the belt. For heating the roll, a steam line 34 is connected to a gland at the end of the hollow roll. At the location of the roll 33, an upper felt 35 comes down onto the web and the web is transferred onto the felt to pass down with the felt over a roll 36. A lower felt 37*a* receives the web and the felts pass over dryer rolls 38 and 39 in serpentine fashion in a normal manner. At this point the web will have been dried to substantially 50% bone dry so it will have the strength to be carried through the dryer drums.

With this arrangement, speeds on the order of 4,000 feet per minute and higher can be accomplished without damage to the web. The drying of the web in the first or intermediate run between the press and the dryer drums does not only dry the web to a degree where it has strength because of its dryness, but has dried it in a fashion while under continuous support without flexure which increases its strength.

FIG. 5 shows in greater detail the manner in which the paper web is fed from the press section onto the first dryer section. In initial threading, the web is run through the press section by feeding a tail (a narrow strip of web) as fed through the press section and passed directly downwardly following the last press nip off of the press roll 14. A doctor blade 41 against the surface of the press roll 14 deflects the web tail 40 downwardly into the broke pit. When the web is established full width, the tail is cut and threaded through the dryer. For this threading, the roll 19 is in the righthand dotted line position 19*a* shown in FIG. 5. When the tail has been established through the dryer, roll 19 is then moved to its solid line position and the web is expanded to its full width. The web tension over the rolls in the dryer is aided by the fact that the dryer section is operated at a faster linear speed than the press section.

FIG. 6 illustrates the path of the web and the position of rolls at the running position and threading position at the finishing of the first dryer section where the web is fed to the second dryer section.

As illustrated in FIG. 6, for threading, the felt roll 42 is brought into the lower solid line position, and the tail led across the space to the dryer roll 36 immediately following the felt guide roll 44. The dryer roll 36 is sometimes referred to as a "baby dryer" and operates to secure the web to the felt 35. A large drying capacity is not needed for this dryer roll because of the small wrap. The web then continues down on the upper felt where it is received by the lower felt 37. After threading, the roll 42 is moved up to the dotted line position which is its normal operating position.

Figure 7:
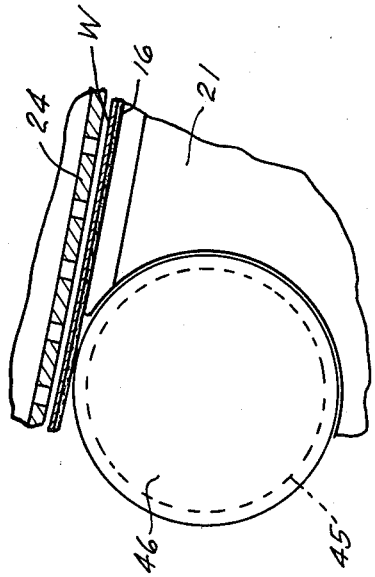
FIG. 7 is a fragmentary side elevational view similar to FIG. 2 showing an alternate form of the invention.

As illustrated in FIG. 7, a structure different from FIG. 1 may be employed in that instead of the suction rolls, grooved rolls 46 are employed between each of the suction zones 21 supporting the belt 16. The grooved rolls have a plurality of adjacent circumferential grooves 45 along their surface, and it has been discovered that these operate to remove air from beneath the belt 16 preventing any lifting of the web carried on the upper surface of the belt.

Thus, it will be seen that we have provided an improved method and mechanism which meets the objectives set forth and is capable of improved use in a paper making machine for achieving high speeds particularly in the making of newsprint.

We claim:

1. The method of dewatering a web in a paper making machine, which comprises:

pressing the web for removal of water therefrom;

thereafter immediately continuously supporting the web on the upper surface of a continuous belt supported on a long convex arcuate run defined by a series of horizontal rolls with the belt depending downwardly between the rolls while subjecting the web to a downward flow of heated air along said run with the belt being curved arcuately upwardly and the web thereby being maintained taut on the upper surface of the belt preventing flutter and wrinkling of the web; and thereafter passing the web over a second thermal drying run over a plurality of heated dryer drums.

2. The method of dewatering a web in a paper making machine in accordance with the steps of claim 1:

wherein the web is first pressed to a moisture content on the order of 40% bone dry before being subjected to the flow of heated air.

3. The method of dewatering a web in a paper making machine in accordance with the steps of claim 1:

wherein the web is first pressed to a dryness substantially 40% bone dry in the pressing operation and is dewatered to a dryness on the order of 50% bone dry by the heated air prior to passing onto the dryer drums.

4. The method of dewatering a web in a paper making machine in accordance with the steps of claim 1:

wherein the drying performed by the heated air while the web is continuously supported removes the moisture to the extent of dewatering the web in the range of from 35% to 45% bone dryness at the beginning of the run to the range of 45% to 55% bone dryness at the end of the run.

5. The method of dewatering a web in a paper making machine in accordance with the steps of claim 1:

including applying a substantially continuous suction beneath the belt for the run.

6. In a paper making machine, a dryer section for thermally drying a wet web between a press section and a dryer drum section, comprising in combination:

press means for dewatering a fibrous web in a press section;

a first thermal dryer section positioned to receive the web from the press means and including a belt having an elongate continuously upwardly facing support surface extending over a dryer first run for continuously carrying the web and providing continuous support without flutter and wrinkling;

support means supporting the belt along said run including a plurality of spaced horizontal rolls successively arranged to support the belt in an upwardly convex arc of curvature for tensioning the belt without flutter and so that the web follows the same on the surface of the belt and the web is taut on the belt to avoid wrinkling;

said belt depending downwardly between rolls with the web remaining supported on the belt surface;

hot air generating means positioned above the web on the belt for directing uniform flow of air over the exposed surface of the web along said run;

first transfer means at the lead end of the run for transferring the web onto the belt;

a second thermal dryer section having a plurality of heated dryer drums with felts threaded over the drums for forming a second dryer run positioned for receiving the web from the first run;

and second transfer means at the terminal end of said dryer first run for transferring the web off the run to the second dryer section; said hot air generating means thermally drying the supported web continuously along said first run without flutter and without wrinkling.

7. In a paper making machine, a dryer section for thermally drying a wet web between a press section and a dryer drum section constructed in accordance with claim 6:

wherein said supporting means includes a plurality of suction boxes having porous suction surfaces against the belt and wherein said belt is formed of a porous material.

8. In a paper making machine, a dryer section for thermally drying a wet web between a press section and a dryer drum section constructed in accordance with claim 6:

wherein said belt is formed of a porous material and the rolls are perforate hollow roll shells with suction means therein.

9. In a paper making machine, a dryer section for thermally drying a wet web between a press section and a dryer drum section constructed in accordance with claim 6:

wherein said supporting means is provided by said rolls and means defining suction zones between said rolls.

10. In a paper making machine, a dryer section for thermally drying a wet web between a press section and a dryer drum section constructed in accordance with claim 9:

wherein the belt forms a catenary curve between each of the rolls and the suction means have belt facing surfaces having a curvature of the belt.

11. In a paper making machine, a dryer section for thermally drying a wet web between a press section and a dryer drum section comprising in combination:

a belt having an elongate continuously upwardly facing support surface extending over a dryer run for continuously carrying the web and providing continuous support without flutter and wrinkling;

means supporting the belt along said run;

hot air generating means positioned above the web on the belt for directing uniform flow of air over the exposed surface along said run;

first transfer means at the lead end of the run for transferring the web onto the belt;

second transfer means at the terminal end of the run for transferring the web off the run to a dryer drum section;

said hot air generating means thermally drying the supported web continuously along said run without flutter and without wrinkling;

said supporting means being provided by a plurality of alternate rolls and means defining suction zones;

the belt forming a catenary curve between each of the rolls and the suction means;

said suction means having boxes having belt facing surfaces having a curvature conforming to the curvature of the belt;

and wherein the edges of the curved boxes have plastic shoes having the curvature of the boxes.

* * * * *